US005818486A

United States Patent [19]

Koike et al.

[11] Patent Number: 5,818,486

[45] Date of Patent: Oct. 6, 1998

[54] INK-JET TEXTILE PRINTING PROCESS

[75] Inventors: Shoji Koike; Tomoya Yamamoto, both of Yokohama, Japan

[73] Assignee: Canon Kabushiki Kaisha, Tokyo, Japan

[21] Appl. No.: 815,412

[22] Filed: Mar. 11, 1997

Related U.S. Application Data

[63] Continuation of Ser. No. 453,376, May 30, 1995, abandoned, which is a continuation of Ser. No. 8,553, Jan. 22, 1993, abandoned.

[30] Foreign Application Priority Data

Jan. 27, 1992 [JP] Japan ..... 4-012094

[51] Int. Cl.[6] ..... B41J 2/05

[52] U.S. Cl. ..... 347/101; 347/106

[58] Field of Search ..... 347/106, 101

[56] References Cited

U.S. PATENT DOCUMENTS

| | | | |
|---|---|---|---|
| 4,395,287 | 7/1983 | Kobayashi | 106/20 |
| 4,458,256 | 7/1984 | Shirato et al. | 347/58 X |
| 4,542,059 | 9/1985 | Toganoh | 347/105 X |
| 4,560,997 | 12/1985 | Sato | 347/15 |
| 4,597,794 | 7/1986 | Ohta et al. | 106/20 |
| 4,636,409 | 1/1987 | Arai et al. | 347/105 X |
| 4,642,654 | 2/1987 | Toganoh | 347/105 X |
| 4,675,693 | 6/1987 | Yano et al. | 347/100 X |
| 4,689,078 | 8/1987 | Koike et al. | 347/100 X |
| 4,702,742 | 10/1987 | Iwata et al. | 8/495 |
| 4,723,129 | 2/1988 | Endo | 347/56 |
| 4,725,849 | 2/1988 | Koike et al. | 347/106 X |
| 4,849,770 | 7/1989 | Koike | 347/100 |
| 4,931,810 | 6/1990 | Iwata | 347/100 X |
| 4,947,190 | 8/1990 | Mizusawa | 347/33 |
| 4,969,951 | 11/1990 | Koike et al. | 347/106 X |
| 5,250,121 | 10/1993 | Yammoto et al. | 347/106 X |
| 5,396,275 | 3/1995 | Koike et al. | 347/106 X |

FOREIGN PATENT DOCUMENTS

| | | | |
|---|---|---|---|
| 54-59936 | 5/1979 | Japan . | |
| 62-053492 | 3/1987 | Japan | B41F 17/00 |

OTHER PUBLICATIONS

Advertisement "High Speed, Print Quality in a Compact Printer BJ–80 . . . " (1985).

Abstract of Japanese Laid–Open Patent Application No. 62–243890.

*Primary Examiner*—Joseph W. Hartary

*Attorney, Agent, or Firm*—Fitzpatrick, Cella, Harper & Scinto

[57] ABSTRACT

Provided is an ink-jet textile printing process imparting an ink to a cloth by ink-jet method, which process comprises at least the following three steps of (a) imparting dots with a dot diameter of from r to 2r (r is nozzle pitch) to said cloth, by causing ink droplets to fly by means of a head having a plurality of nozzles capable of making a record at equal intervals in a density of from 3 nozzles/mm to 35 nozzles/mm;

(b) diffusing the ink dots adhered to the cloth within a range of from 0.2r to 3r as an increase in said dot diameter and simultaneously dyeing the cloth with the dye diffused in said cloth, by applying to said cloth having been subjected to the step (a) a heat treatment at 90° C. to 150° C. accompanied by steam;

(c) washing away a dye having not been adsorbed or fixed.

36 Claims, 3 Drawing Sheets

INK-JET TEXTILE PRINTING PROCESS

This application is a continuation of application Ser. No. 08/453,376, filed May 30, 1995, which is a continuation of application Ser. No. 08/008,553, filed Jan. 22, 1993, both now abandoned.

BACKGROUND OF THE INVENTION

1. Field of the Invention

The present invention relates to a process for the dyeing or the textile-printing on cloths by an ink-jet method.

2. Related Background Art

Screen textile printing and roller textile printing are presently prevailing as textile printing. These methods, however, are not suited for the multi-item and small-quantity production and cannot quickly respond to fashion with ease. Accordingly, there is a recent demand for establishing electronic textile printing systems that require no printing plates. To answer such a demand, a number of proposals have been made on textile printing carried out by ink-jet method, which increasingly attracts expectations from various fields.

Inks for ink-jet textile printing are required to satisfy the following:

(1) They impart densities sufficient for color formation.

(2) They have a high color yield to cloths and enable easy effluent treatment after the step of washing.

(3) They cause less irregular bleeding on cloths when different colors are mixed.

(4) They have a good levelness and can achieve color reproduction in a wide range.

(5) They can be free from difficulties caused by image disorder due to faulty ejection such as ink-ejection failure or ejection twist that may occur during the step of imparting inks.

In order to satisfy these requirements, it has been hitherto mainly attempted to add various additives to inks, to control ink-shot quantities and to apply a pretreatment to cloths. Using these methods only, however, it has been impossible to satisfy the above requirements.

Accordingly, it is reasonably difficult to satisfy these requirements at the same time and also carry out level dyeing on cloths. In particular, under existing circumstances, it has not been attempted to satisfy the requirements (2) and (5).

In addition, the textile printing on cloths requires as a final step the step of washing cloths to remove therefrom dyes having not adsorbed or fixed, and must be handled in a different way than in the case of the usual recording on paper that requires no conventional washing step.

Moreover, dyes are used in a large quantity because of a low color yield of dyes in conventional methods such as screen textile printing and roller textile printing making use of a thickner, resulting in effluence of dyes during the washing step to cause an environmental pollution.

SUMMARY OF THE INVENTION

Accordingly, an object of the present invention is to provide a textile printing process that can satisfy the aforesaid requirements hitherto commonly made in ink-jet textile printing, i.e., the requirements to obtain sharp, highly dense and highly precise dyed articles.

Another object of the present invention is to provide a textile printing process that can achieve a high color yield.

The above objects of the present invention can be achieved by the invention described below.

The present invention provides an ink-jet textile printing process imparting an ink to a cloth by ink-jet method, which process comprises at least the following three steps of (a) imparting dots with a dot diameter of from r to 2r is (r is nozzle pitch) to said cloth, by causing ink droplets to fly by means of a head having a plurality of nozzles capable of making a print at equal intervals in a density of from 3 nozzles/mm to 35 nozzles/mm;

(b) diffusing the ink adhered to the cloth and simultaneously dyeing the cloth with the dye diffused in said cloth, by applying to said cloth having been subjected to the step (a) a heat treatment at 90° C. to 150° C. accompanied by steam; and (c) washing away a dye having not been absorbed or fixed; and said ink on said cloth in the step (b) being made to diffuse within the range of from 0.2r to 3r as a gain of dot diameter.

The present invention also provides an ink-jet textile printing process imparting an ink to a cloth by ink-jet method, which process comprises at least the following three steps of (a) imparting dots with a dot diameter of from r to 2r (r is nozzle pitch) to said cloth, by causing ink droplets to fly by means of a head having a plurality of nozzles capable of making a print at equal intervals in a density of from 3 nozzles/mm to 35 nozzles/mm;

(b) diffusing the ink adhered to the cloth and simultaneously dyeing the cloth with the dye diffused in said cloth, by applying to said cloth having been subjected to the step (a) a dry heat treatment at 100° C. to 200° C.; and (c) washing away a dye having not been adsorbed or fixed; and said ink on said cloth in the step (b) being made to diffuse within the range of from 0.2r to 3r as a gain of dot diameter.

The present invention also provides a textile-printed article having been textile-printed by the above ink-jet textile printing process.

The present invention further provides a process for producing a textile-printed article, comprising producing a textile-printed cloth by the above ink-jet textile printing process.

DESCRIPTION OF THE PREFERRED EMBODIMENTS

Figure 1:
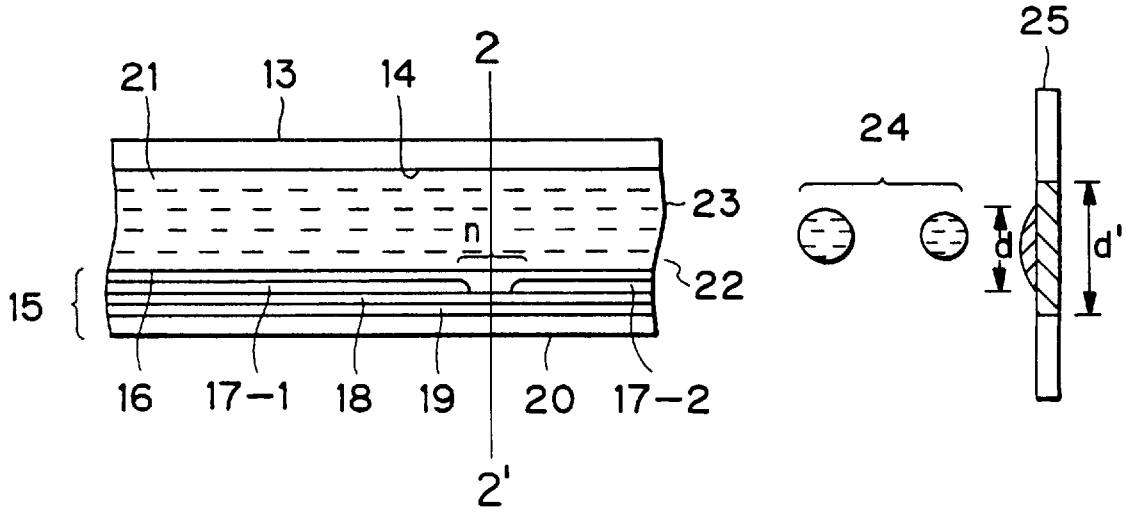
FIG. 1 illustrates a partial cross section of an orifice of a head of an ink-jet apparatus used when the present invention is worked.

The present inventors have made studies in order to find a way to satisfy all the aforesaid required performances at the same time in ink-jet color textile printing processes. As a result, they have discovered that the dot diameter of the ink adhered to a cloth should be controlled by adjusting ink droplet volume and ink composition so as to have a dot diameter corresponding with a nozzle pitch, and the ink diffusion also corresponding with the nozzle pitch should be promoted in a heat treatment carried out for dyeing a cloth with dyes imparted to the cloth, stated specifically, the dot diameter should be made larger by 0.2r to 3r (r is nozzle pitch) as an absolute quantity than the initial dot diameter of the ink adhered to the cloth, whereby it is possible, without causing any irregular bleeding, to much better prevent difficulties involved in conventional ink-jet textile printing, caused by image disorder due to faulty ejection such as ink-ejection failure or ejection twist that may occur during the step of imparting inks.

They have also discovered that the levelness can be improved, e.g., uneveness in dyeing, particularly questioned in solid-printed areas, can be better prevented, and also the color yield can be improved. Dyes must be used in a large quantity because of a low color yield of dyes in conventional methods making use of a thickner such as screen textile printing and roller textile printing, so that the heating carried out for a long time in the heat treatment makes bleeding very large and also frequently causes irregular bleeding. Hence, because of a great difficulty in the selection of heating conditions, it has been almost impossible to prevent the disorder of images.

The ink-jet textile printing of the present invention can make the color yield reasonably higher and allows it to impart dyes in smaller quantities. Such advantages enable more remarkable prevention of bleeding than in the cases of any conventional methods even when the heating is carried out for a long time. Hence it is also possible to control the step of ink diffusion carried out for the purpose stated above.

The present invention will be described below in greater detail by giving preferred embodiments of the invention.

A material that constitutes the cloth used in the present invention may include natural fibers, regenerated fibers, semisynthetic fibers and synthetic fibers, and there are no particular limitations to the material. It is particularly preferable to use cotton, silk, nylon or polyester, alone or in the form of a textile blend.

In order to obtain better textile printed articles, the cloth described above may preferably be subjected to a conventional pretreatment. In particular, it is more preferable to use a cloth made to contain from 0.01 to 5% by weight of an alkaline material or a cloth made to contain from 0.01 to 20% by weight of a substance selected from the group consisting of a water-soluble metal salt, a water-soluble polymer, a synthetic polymer, urea and thiourea.

The alkaline materials may include, for example, alkali metal hydroxides such as sodium hydroxide and potassium hydroxide, amines such as mono-, di- or triethanolamine, and alkali metal carbonates or hydrogencarbonate such as sodium carbonate, potassium carbonate and sodium hydrogencarbonate. It may also include organic acid metal salts such as calcium acetate and barium acetate, or ammonia and ammonia compounds. It is also possible to use sodium trichloroacetate, capable of being converted into an alkaline material under steaming and dry heating. Particularly preferable alkaline materials are sodium carbonate and sodium bicarbonate used when dyeing with reactive dyes.

The water-soluble polymers may include natural water-soluble polymers as exemplified by starch type materials such as corn and wheat, cellulose type materials such as carboxymethyl cellulose, methyl cellulose and hydroxyethyl cellulose, polysaccharides such as sodium alginate, gum arabic, locust bean gum, tragacanth gum, guar gum and tamarind seeds, protein type materials such as gelatin and casein, tannin type materials, and lignin type materials.

The synthetic polymers may include, for example, polyvinyl alcohol compounds, polyethylene oxide compounds, acrylic acid water-soluble polymers and maleic anhydride water-soluble polymers. In particular, polysaccharide polymers and cellulose polymers are preferred.

The water-soluble metal salts may include compounds capable of producing a typical ionic crystal and having a pH from 4 to 10, as exemplified by alkali metals and alkaline earth metals. Typical examples of such compounds are alkali metals such as NaCl, $Na_2SO_4$, KCl and $CH_3COONa$, and alkaline earth metals such as $CaCl_2$ and $MgCl_2$. In particular, salts of Na, K or Ca are preferred.

The textile printing ink used in the present invention is comprised of a coloring matter, water, an organic solvent, additives and so forth.

The coloring matters may preferably include dyes, and any dyes dyeable to the cloth can be used. It is possible to use acid dyes, direct dyes, cationic dyes, reactive dyes, disperse dyes and vat dyes. One or more kinds of these dyes are contained in the ink, and may be used in combination with a dye having a different hue. They may be used usually in an amount of from 2 to 30% by weight, preferably from 3 to 25% by weight, and more preferably from 4 to 20% by weight, in total based on the total weight of the ink.

The water, which is preferable as the main component of the ink, may be contained in an amount ranging from 10 to 93% by weight, preferably from 25 to 87% by weight, and more preferably from 30 to 80% by weight, based on the total weight of the ink.

The organic solvents may include, for example, ketones or ketoalcohols such as acetone and diacetone alcohol; ethers such as tetrahydrofuran and dioxane; addition polymers of oxyethylene or oxypropylene such as diethylene glycol, triethylene glycol, tetraethylene glycol, dipropylene glycol, tripropylene glycol, polyethylene glycol and polypropylene glycol; alkylene glycols whose alkylene group has 2 to 6 carbon atoms, such as ethylene glycol, propylene glycol, trimethylene glycol, butylene glycol and hexylene glycol; triols such as 1,2,6-hexanetriol; thiodiglycol; glycerol; lower alkyl ethers of polyhydric alcohols such as ethylene glycol monomethyl or -ethyl ether, diethylene glycol monomethyl or -ethyl ether and triethylene glycol monomethyl or -ethyl ether; lower dialkyl ethers of polyhydric alcohols such as triethylene glycol dimethyl or -ethyl ether and tetraethylene glycol dimethyl or -ethyl ether; sulfolane, N-methyl-2-pyrrolidone, and 1,3-dimethyl-2-imidazolidinone.

The above organic solvent may be contained usually in an amount ranging from 3% to 60% by weight, and preferably from 5% to 50% by weight, based on the total weight of the ink.

When the medium as described above is used in combination, it may be used alone or in the form of a mixture. Use of a medium containing a solvent having a vapor pressure of 0.02 mmHg or less at 20° C. is advantageous for the diffusion by heating. A preferred liquid medium is so composed that the solvent contains at least one polyhydric alcohol. In particular, thiodiglycol alone or a mixed system of diethylene glycol and thiodiglycol is particularly preferred.

As to other additive components, a chloride ion and/or a sulfate ion may be contained in an amount of from 10 to 20,000 ppm based on the dyes in the ink. This is preferable since color forming performances such as levelness and color yield can be more improved.

Main components of the ink used in the present invention are as described above. If necessary, other various kinds of dispersants, surface active agents, viscosity modifiers, surface tension modifiers, fluorescent brightening agents and so forth may be added.

For example, they may include viscosity modifiers such as polyvinyl alcohol, celluloses and water-soluble resins, various surface active agents of a cationic or nonionic type, surface tension modifiers such as diethanolamine and triethanolamine, pH adjusters comprising a buffer, and anti-fungal agents.

As the ink-jet printing system for imparting the aforesaid ink to the cloth, it is possible to use a piezoelectric system or a thermal-jet system, known in the art.

Figure 2:
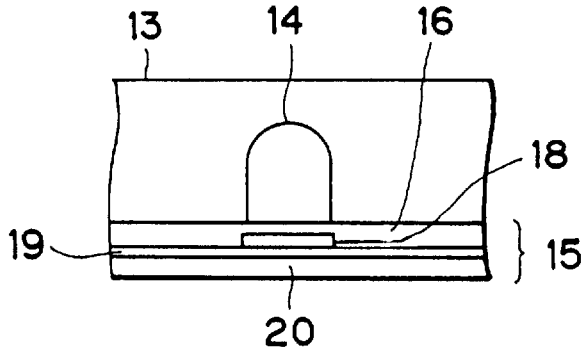
FIG. 2 is a cross section of the orifice along the line 2–2' in FIG. 1.
Figure 3:
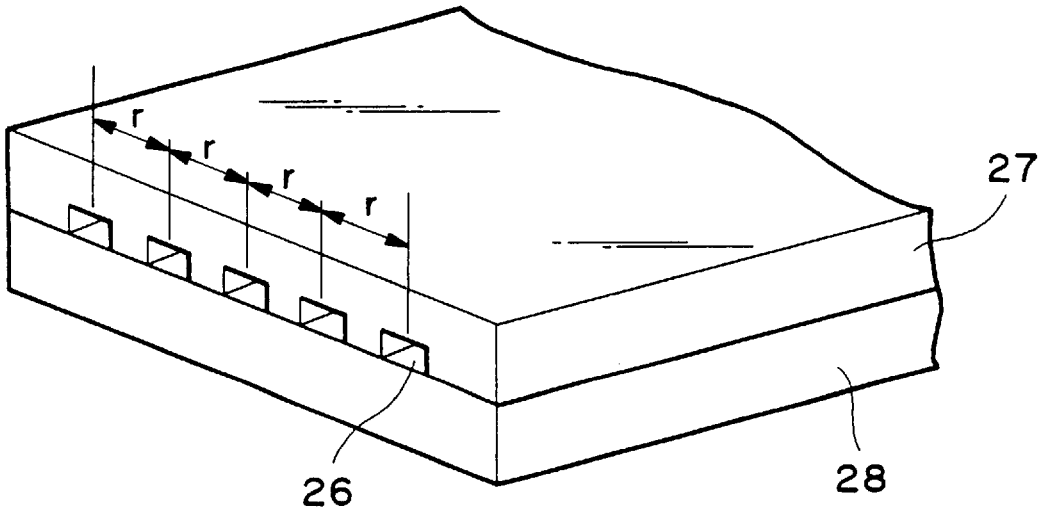
FIG. 3 is a perspective illustration of an ink-jet multi-nozzle head used when the present invention is worked.
Figure 4:
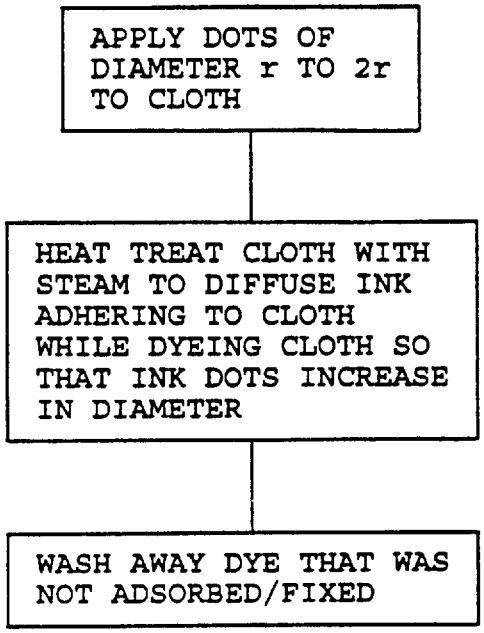
FIGS. 4 and 5 are flow charts depicting the claimed textile printing process.
Figure 5:
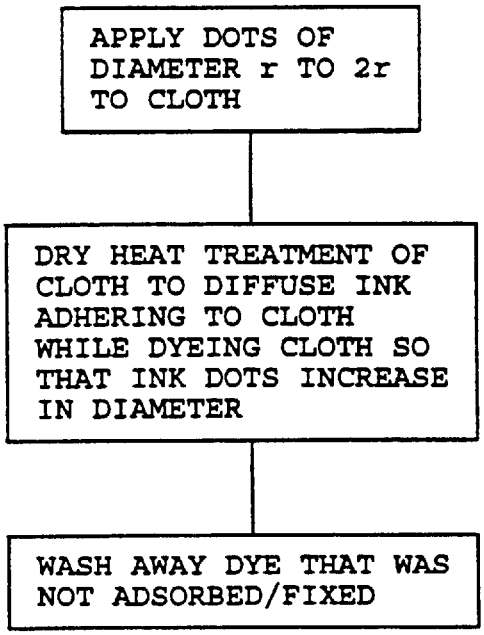

FIGS. 1, 2 and 3 show the structure of the head used in the present invention, taking the thermal-jet system as an example.

A head 13 is formed by bonding a glass, ceramic or plastic plate or the like having a channel 14 through which ink is passed, to a heating head 15 used in thermal recording (the drawing shows a thin-film head, to which, however, it is not limited). The heating head 15 is comprised of a protective film 16 formed of silicon oxide or the like, aluminum electrodes 17-1 and 17-2, a heating resistor layer 18 formed of nichrome or the like, a heat accumulating layer 19, and a substrate 20 with good heat dissipation properties, made of alumina or the like.

Ink 21 stands reached an ejection orifice (a minute opening) 22 and a meniscus 23 is formed there by a pressure P.

Upon application of electric signals to the electrodes 17-1 and 17-2, heat is abruptly generated at the region denoted by n in the thermal head 15, so that bubbles are generated in the ink 21 coming into contact with this region. The pressure thus produced thrusts out the meniscus 23 and the ink 21 is ejected from the orifice 22 in the form of printing minute drops 24 to fly against a cloth piece 25. FIG. 3 illustrates the appearance of a multi-head comprising the head as shown in FIG. 1 arranged in a large number. The multi-head is prepared by closely bonding a glass plate 27 having a multi-channel 26, to a heating head 28 similar to the one as illustrated in FIG. 1. Meanwhile, FIG. 1 illustrates a partial cross section of a head, along a passage of ink. FIG. 2 is a cross section along the line 2—2 in FIG. 1.

The nozzle pitch r referred to in the present invention indicates, in an instance in which the direction of nozzle arrangement and the printing direction with respect to the cloth fall at right angles with each other, a distance connecting the centers of adjoining nozzle orifices of the multi-nozzle head as shown in FIG. 3.

The head used in the present invention has a plurality of nozzles capable of making a print at equal intervals in a density of from 3 nozzles/mm to 35 nozzles/mm, and imparts an ink so as for the dot of the ink adhered to the cloth to have a diameter of from r to 2r.

This dot diameter of the ink adhered to the cloth is controlled by adjusting cloth treatment, droplet quantity, ink ejection velocity and physical properties of ink. For example, with reference to physical properties of ink, the dot diameter of the ink adhered to the cloth generally tends to become larger with a decrease in surface tension and viscosity.

In the present invention, the nozzle density of the head and the dot diameter of the ink adhered to the cloth are limited to the specific range for the following reasons.

Printed articles obtained by an ink-jet method have a possibility of providing strikingly detailed designs or patterns compared with screen printing and roller printing, and hence the level of the required performances as exemplified by anti-bleeding the present invention aims at is much higher than what has been questioned in the prior art. Nozzle intervals of less than 3 nozzles/mm give a low resolution to bring about a difficulty. On the other hand, nozzle intervals of more than 35 nozzles/mm may allow ink droplets to pass through the texture of cloth, making it meaningless to enhance resolution. In addition, in order to obtain optimum images on the basis of the nozzle intervals in the textile printing of the present invention, the dot diameter of the ink adhered to the cloth has been confirmed to be in the range of from r to 2r, which corresponds to the nozzle pitch. Thus, no good points of ink-jet textile printing can be exhibited and also the present invention can not be remarkably effective unless the printing conditions are within the above ranges.

Besides the foregoing characteristic features, the quantity of the dye adhered (or built up) to cloths by imparting thereto the textile printing ink should preferably be controlled within the range of from 0.025 to 1 mg/cm$^2$. When plurality of inks of different colors is used, this quantity of dye is indicated as the total quantity of dyes corresponding to that colors, and can be determined by actually measuring ejection quantity of the ink and dye concentration in the ink.

Next, the cloth is dyed with the ink imparted thereto under conditions described above and the ink is further made to diffuse. This step is a step characterizing the present invention. In the heat treatment to dye the cloth with the ink imparted thereto, the ink is made to diffuse within the range of from 0.2r to 3r, preferably from 0.3r to 2.9r, and more preferably from 0.5r to 2.8r, as a gain of dot diameter with respect to the initial dot diameter of the ink adhered to the cloth. If the diffusion is less than 0.2r, no improvement can be seen in respect of faulty ejection image disorder or color yield. If it is more than 3r, the problem of bleeding may be caused on detailed images.

The heat treatment carried out here may be applied by a conventionally known method, as exemplified by steaming, HT steaming, thermo-fixing, or, in an instance in which a cloth having been alkali-treated is not used when an alkali agent is required in fixing, alkali pad steaming, alkali blotch steaming, or alkali shock treatment.

The heating conditions are controlled according to temperature and time which depend whether or not the heating is accompanied by steam, but may vary depending on use conditions such as dyes, cloths, an ink composition and a nozzle pitch. It can not be absolutely said what conditions are optimum.

For example, with reference to the cloths, conditions may greatly vary depending on the materials themselves of cloths or whether or not cloths have been pretreated. With reference to the ink composition, the vapor pressure, dye-dissolving power and content of solvents contained have a great influence. Moreover, molecular weights of coloring matters and number of hydrophilic groups thereof must be taken into account to control heating conditions.

Accordingly, in order to always achieve stable dyeing with a good reproducibility, the heating conditions in the present invention must be strictly controlled according to what articles are textile-printed.

In the case of the heating accompanied by steam, the temperature is, in general, in the range of from 90° to 150° C. In the case of dry heating, it is in the range of from 100° to 200° C. At the temperature of this range, vapor quantity, heating time and so forth are controlled so as to give the diffusion quantity determined on the basis of the nozzle pitch.

Preferred heating conditions according to combinations of dyes and fibers can be roughly set as follows: For example, in the case of the heating accompanied by steam; the heating may be carried out approximately at 90° to 150° C. for 10 seconds to 30 minutes in the combination of a reactive dye and cotton, approximately at 95° to 105° C. for 30 to 120 minutes in the combination of an acid dye and wool, approximately at 95° to 105° C. for 30 to 120 minutes in the combination of an acid dye and silk or nylon, approximately at 95° to 105° C. for 10 to 120 minutes in the combination of a reactive dye or direct dye and rayon, approximately at 100° to 110° C. for 30 to 120 minutes in the combination of a cationic dye and acrylic fiber, and approximately at 100° to 130° C. for 20 to 120 minutes in the combination of a disperse dye and polyester or acetate, all of which are rough standards. However, there are no particular limitations on the heating conditions since the object of the present invention can be achieved if the prescribed diffusion quantity is attained. In the present invention, the cloth having been subjected to the above treatment is subsequently washed to remove dyes having not been adsorbed or fixed, using a conventionally known method.

EXAMPLES

The present invention will be described below in greater detail by giving Examples and Comparative Examples. In the following, "part(s)" and "%" are by weight.

| | |
|---|---|
| I. Preparation of inks: | |
| 1. Reactive dye inks: | |
| Reactive dye | 15 parts |
| Thiodiglycol | 24 parts |
| Diethylene glycol | 21 parts |
| Potassium chloride | 0.004 part |
| Sodium sulfate | 0.002 part |
| Water | 40 parts |
| Dyes used were as follows: | |
| Yellow ink | |
| C.I. Reactive Yellow 95 | |
| Magenta ink | |
| C.I. Reactive Red 226 | |
| Cyan ink | |
| C.I. Reactive Blue 15 | |
| Black ink | |
| C.I. Reactive Black 39 | |

The above components were respectively mixed. The aqueous mixture obtained each was adjusted to pH 8.4 using sodium hydroxide, and stirred for 2 hours, followed by filtration using Fluoropore Filter FP-100 (trade name; available from Sumitomo Electric Industries, Ltd.) to give a water-based ink.

| | |
|---|---|
| 2. Acid dye inks: | |
| Acid dye | 10 parts |
| Thiodiglycol | 23 parts |
| Triethylene glycol monomethyl ether | 16 parts |
| Potassium chloride | 0.05 part |
| Water | 51 parts |
| Dyes used were as follows: | |
| Yellow ink | |
| C.I. Acid Yellow 110 | |
| Magenta ink | |
| C.I. Acid Red 266 | |
| Cyan ink | |
| C.I. Acid Blue 90 | |
| Black ink | |
| C.I. Acid Black 26 | |

The above components were respectively mixed. The aqueous mixture obtained each was adjusted to pH 4.8 using acetic acid, and stirred for 2 hours, followed by filtration using Fluoropore Filter FP-100 (trade name; available from Sumitomo Electric Industries, Ltd.) to give a water-based ink.

II. Ink-jet dyeing apparatus:

An ink-jet apparatus making use of the following head A or B was used after modified so as to enable control of suitable quantity of ejected liquid.

Head A:

256 nozzles (400 dots/inch; 16 nozzles/mm; orifice: 25 μm×23 μm)

Head B:

128 nozzles (200 dots/inch; 8 nozzles/mm; orifice: 44 μm×44 μm)

1. Ink-jet recording system: On-Demand type
2. Head voltage: 20 to 40 V
3. Head temperature: 20° to 60° C.
4. Driving pulse width: 3 to 20 μs
5. Driving frequency: 0.5 to 2 kHz
6. Distance between nozzle and fabric: 1 mm III. Pretreatment of cloth:

The following six kinds of fabrics were used. Fabrics a to c were previously immersed in a solution comprised of 1 part of sodium alginate, 2 parts of sodium hydrogencarbonate and 97 parts of water, and fabrics d to f in a solution comprised of 1 part of sodium alginate, 2 parts of polyvinyl formal and 97 parts of water, followed by padding at a pickup of 60% and then drying at 100° C. for 5 minutes.

a. Hirajihosonuno (a Japanese term meaning plain fabric with a narrow cloth width; 100% cotton)

b. Ayaji-kasaji (a Japanese term meaning figured cloth used for making umbrellas; 100% cotton)

c. Hiraji lawn (a Japanese-English composite term meaning plain thin cotton fabric; 100% cotton)

d. Habutae 8-monmetsuki (a Japanese term meaning 1.056-ounce glossy silk; 100% silk)

e. Shoken shusu 10-monmetsuki (a Japanese term meaning 1.32-ounce silk satin; 100% silk)

f. Georgette crape (100% silk)

IV. Operation:

Using the above reactive dye black ink and cloths a to c, a single dot and a 10 mm×20 mm solid print sample were printed using the above ink-jet apparatus, where the dot diameter of the ink adhered to the cloth before the step of heating was varied as shown in Table 1. The dot diameter of the ink adhered to the cloth was adjusted by managing driving conditions (head voltage, head temperature, driving pulse width, driving frequency) of the ink-jet apparatus to change ejected droplet quantity within the range of from 20 to 50 pl. The printed cloths were thereafter subjected to a heat treatment under conditions varied as shown in Table 1 to adjust the diffusion of dots, followed by washing and then drying. With regard to the diffusion of dots, a gain of dot diameter after the heat treatment was determined on the basis of nozzle pitch (r). For the textile-printed cloths, evaluation was made on their sharpness and on whether or not any uneveness of solid prints was caused by twist or ejection failure (i.e., levelness). Optical densities (OD) of solid print were also measured to be used as criteria for judging the color yield. As a result, sharpest and good solid prints without causing any uneveness were obtained, when the initial dot diameter of the ink adhered to the cloth was in the range of r to 2r and the ink thus adhered was diffused by the heat treatment by 0.2r to 3r as a gain of dot diameter. Color yield was also judged by relative evaluation of OD values to reveal that it was good when the ink adhered was diffused by the heat treatment by 0.2r to 3r as a gain of dot diameter, and decreased when the diffusion was less than 0.2r.

Color print samples formed using the reactive dye inks of four different colors were similarly examined. As a result, good prints were obtained without any conspicuous bleeding at mixed color areas.

TABLE 1

| | Example | | | | | Comparative Example | | | |
|---|---|---|---|---|---|---|---|---|---|
| | 1 | 2 | 3 | 4 | 5 | 1 | 2 | 3 | 4 |
| Cloth used: | a | a | a | b | c | a | a | b | b |
| Nozzle pitch (r)*1: | 63.5 | 63.5 | 127 | 63.5 | 63.5 | 63.5 | 63.5 | 63.5 | 63.5 |
| Dot diameter before heating*2: | 1.0 r | 2.0 r | 1.5 r | 1.5 r | 1.2 r | 0.9 r | 2.1 r | 1.2 r | 1.2 r |
| Gain of dot diameter after heating*3: | 3.0 r | 0.2 r | 0.8 r | 1.5 r | 2.0 r | 1.2 r | 1.5 r | 0.1 r | 3.5 r |
| Heating method*4: | Steaming | Steaming | Steaming | Dry heating | Steaming | Steaming | Steaming | Dry heating | Dry heating |
| Temperature (°C.): | 100 | 100 | 100 | 150 | 100 | 100 | 100 | 150 | 150 |
| Time (hr): | 0.5 | 0.1 | 0.2 | 0.5 | 0.3 | 0.2 | 0.2 | 0.1 | 1.0 |
| Sharpness*5: | A | A | A | A | A | B | C | B | C |
| Uneveness on solid print*6: | A | A | A | A | A | B | B | C | A |
| Average value of OD: | 1.38 | 1.44 | 1.42 | 1.41 | 1.45 | 1.39 | 1.40 | 1.25 | 1.41 |

*1: In the head A or B, nozzle pitch (r) is as follows:
Head A: 63.5 μm (16 nozzles/mm)
Head B: 127 μm (8 nozzles/mm)
2*: Dots were magnified with a microscope to determine an average value of diameters of 20 dots, which was indicated as nozzle pitch (r).
*3: Dots were magnified with a microscope to determine an average value of diameters of 20 dots, and a gain of dot diameter was indicated as nozzle pitch (r).
*4: Heat treatment accompanied by steam (i.e. steaming) or heat treatment accompanied by no steam (i.e., dry heating) was carried out.
*5: Any irregular disorders at straight portions of edges of solid print samples were observed with the naked eye to judge the sharpness.
A: There is no disorder at all.
B: There is a little disorder.
C: There is much disorder.
*6: Observed with the naked eye.
A: The area of uneven portions is 0 to 5%.
B: The area of uneven portions is more than 5 to 20%.
C: The area of uneven portions is more than 20%.

Using the above acid dye black ink and cloths d to f, similar examinations as in the case of the reactive dye were made. As a result, as shown in Table 2, similar to the case of the reactive dye ink, good results were obtained when the initial dot diameter of the ink adhered to the cloth was in the range of r to 2r and the ink thus adhered was diffused by the heat treatment by 0.2r to 3r as a gain of dot diameter. Color print samples formed using the acid dye inks of four different colors were similarly examined to also obtain good results.

TABLE 2

| | Example | | | | | Comparative Example | | | |
|---|---|---|---|---|---|---|---|---|---|
| | 6 | 7 | 8 | 9 | 10 | 5 | 6 | 7 | 8 |
| Cloth used: | d | d | d | e | f | d | d | e | e |
| Nozzle pitch (r)*1: | 63.5 | 63.5 | 127 | 63.5 | 63.5 | 63.5 | 63.5 | 63.5 | 63.5 |
| Dot diameter before heating*2: | 1.0 r | 1.9 r | 1.5 r | 1.2 r | 1.2 r | 0.9 r | 2.1 r | 1.2 r | 1.2 r |
| Gain of dot diameter after heating*3: | 2.9 r | 0.2 r | 0.5 r | 1.7 r | 2.2 r | 1.5 r | 1.1 r | 0.1 r | 3.3 r |
| Heating method*4: | Steaming | Steaming | Steaming | Dry heating | Steaming | Steaming | Steaming | Dry heating | Dry heating |
| Temperature ('C.): | 100 | 100 | 100 | 120 | 100 | 100 | 100 | 120 | 120 |
| Time (hr) | 2.0 | 0.5 | 1.0 | 1.5 | 1.5 | 1.5 | 1.0 | 0.2 | 3.0 |
| Sharpness*5: | A | A | A | A | A | B | C | B | C |
| Uneveness on solid print*6: | A | A | A | A | A | B | B | C | A |
| Average value of OD: | 1.36 | 1.40 | 1.40 | 1.39 | 1.41 | 1.37 | 1.40 | 1.22 | 1.38 |

*1: In the head A or B, nozzle pitch (r) is as follows:
Head A: 63.5 μm (16 nozzles/mm)
Head B: 127 μm (8 nozzles/mm)
*2: Dots were magnified with a microscope to determine an average value of diameters of 20 dots, which was indicated as nozzle pitch (r).
*3: Dots were magnified with a microscope to determine an average value of diameters of 20 dots, and a gain of dot diameter was indicated as nozzle pitch (r).
*4: Heat treatment accompanied by steam (i.e. steaming) or heat treatment accompanied by no steam (i.e., dry heating) was carried out.
*5: Any irregular disorders at straight portions of edges of solid print samples were observed with the naked eye to judge the sharpness.
A: There is no disorder at all.

TABLE 2-continued

| | Example | | | | | Comparative Example | | | |
|---|---|---|---|---|---|---|---|---|---|
| | 6 | 7 | 8 | 9 | 10 | 5 | 6 | 7 | 8 |

B: There is a little disorder.
C: There is much disorder.
*6: Observed with the naked eye.
A: The area of uneven portions is 0 to 5%.
B: The area of uneven portions is more than 5 to 20%.
C: The area of uneven portions is more than 20%.

As described above, the color textile printing process of the present invention makes it possible to obtain bleeding-free, sharp, highly dense and highly precise dyed articles.

The present invention can also bring about a remarkable improvement in the color yield in the color textile printing, and can afford to cope with the problem of environmental pollution due to effluents.

What is claimed is:

1. An ink-jet textile printing process of applying an ink to a cloth by an ink-jet method, comprising the steps of:

providing a recording head having a plurality of nozzles disposed at substantially equal intervals, adjacent said nozzles being separated by a pitch distance r, said nozzles being disposed with a density of between 3 nozzles/mm and 35 nozzles/mm;

(a) applying a plurality of ink dots each having a dot diameter of from r to 2r to said cloth, by causing ink droplets to fly by means of said head;

(b) diffusing the ink dots adhered to the cloth within a range of from 0.2r to 3r as an increase in said dot diameter and simultaneously dyeing the cloth with a dye diffused in said cloth, by applying to said cloth, following step (a), a heat treatment at 90° C. to 150° C. accompanied by applying of steam; and (c) washing away that portion of said dye which has not been adsorbed or fixed.

2. The ink-jet textile printing process according to claim 1, wherein said increase in said dot diameter in said step b is between 0.3r and 2.9r.

3. The ink-jet textile printing process according to claim 1, wherein said increase in said dot diameter in said step b is between 0.5r and 2.8r.

4. The ink-jet textile printing process according to claim 1, wherein said ink comprises at least one of a chloride ion and a sulfate ion present at a concentration of between 10 parts per million and 20,000 parts per million based on the dye contained in the ink.

5. The ink-jet textile printing process according to claim 1, wherein said ink comprises a solvent having a vapor pressure of not more than 0.02 mmHg at 20° C.

6. The ink-jet textile printing process according to claim 1, wherein said ink comprises a solvent comprising thiodiglycol or a mixed solvent of thiodiglycol and diethylene glycol.

7. The ink-jet textile printing process according to claim 1, further comprising a step of pretreating said cloth before said step (a).

8. The ink-jet textile printing process according to claim 1, wherein said ink-jet recording process is performed in an On-Demand system.

9. The ink-jet textile printing process according to claim 1, wherein said ink-jet process is performed in a system utilizing a heat energy.

10. An ink-jet textile printing process of applying an ink to a cloth by an ink-jet method, comprising the steps of:

providing a recording head having a plurality of nozzles disposed at substantially equal intervals, adjacent said nozzles being separated by a pitch distance r, said nozzles being disposed with a density of between 3 nozzles/mm and 35 nozzles/mm;

(a) applying a plurality of ink dots each having a dot diameter of from r to 2r to said cloth, by causing ink droplets to fly by means of said head;

(b) diffusing the ink dots adhered to the cloth within a range of from 0.2r to 3r as an increase in said dot diameter and simultaneously dyeing the cloth with a dye diffused in said cloth, by applying to said cloth, following step (a), a dry heat treatment at 100° C. to 200° C.; and (c) washing away that portion of said dye which has not been adsorbed or fixed.

11. The ink-jet textile printing process according to claim 10, wherein said increase in said dot diameter in said step b is between 0.3r and 2.9r.

12. The ink-jet textile printing process according to claim 10, wherein said increase in said dot diameter in said step b is between 0.5r and 2.8r.

13. The ink-jet textile printing process according to claim 10, wherein said ink comprises at least one of a chloride ion and a sulfate ion present at a concentration of between 10 parts per million and 20,000 parts per million based on the dye contained in the ink.

14. The ink-jet textile printing process according to claim 10, wherein said ink comprises a solvent having a vapor pressure of not more than 0.02 mmHg at 20° C.

15. The ink-jet textile printing process according to claim 10, wherein said ink comprises a solvent comprising thiodiglycol or a mixed solvent of thiodiglycol and diethylene glycol.

16. The ink-jet textile printing process according to claim 10, further comprising a step of pretreating said cloth before said step (a).

17. The ink-jet textile printing process according to claim 10, wherein said ink-jet recording process is performed in an On-Demand system.

18. The ink-jet textile printing process according to claim 10, wherein said ink-jet process is performed in a system utilizing a heat energy.

19. A process for producing a textile-printed article, by applying an ink to a cloth by an ink-jet method, comprising the steps of:

providing a recording head having a plurality of nozzles disposed at substantially equal intervals, adjacent said nozzles being separated by a pitch distance r, said nozzles being disposed with a density of between 3 nozzles/mm and 35 nozzles/mm;

(a) applying a plurality of ink dots each having a dot diameter of from r to 2r to said cloth, by causing ink droplets to fly by means of said head;

(b) diffusing the ink dots adhered to the cloth within a range of from 0.2r to 3r as an increase in said dot diameter and simultaneously dyeing the cloth with a dye diffused in said cloth, by applying to said cloth, following step (a), a heat treatment at 90° C. to 150° C. accompanied by applying of steam; and (c) washing away that portion of said dye which has not been adsorbed or fixed.

20. The process according to claim 19, wherein said increase in said dot diameter in said step b is between 0.3r and 2.9r.

21. The process according to claim 19, wherein said increase in said dot diameter in said step b is between 0.5r and 2.8r.

22. The process according to claim 19, wherein said ink comprises at least one of a chloride ion and a sulfate ion present at a concentration of between 10 parts per million and 20,000 parts per million based on the dye contained in the ink.

23. The process according to claim 19, wherein said ink comprises a solvent having a vapor pressure of not more than 0.02 mmHg at 20° C.

24. The process according to claim 19, wherein said ink comprises a solvent comprising thiodiglycol or a mixed solvent of thiodiglycol and diethylene glycol.

25. The process according to claim 19, further comprising a step of pretreating said cloth before said step (a).

26. The process according to claim 19, wherein said ink-jet recording process is performed in an On-Demand system.

27. The process according to claim 19, wherein said ink-jet process is performed in a system utilizing a heat energy.

28. A process for producing a textile-printed article, by applying an ink to a cloth by an ink-jet method, comprising the steps of:

providing a recording head having a plurality of nozzles disposed at substantially equal intervals, adjacent said nozzles being separated by a pitch distance r, said nozzles being disposed with a density of between 3 nozzles/mm and 35 nozzles/mm;

(a) applying a plurality of ink dots each having a dot diameter of from r to 2r to said cloth, by causing ink droplets to fly by means of said head;

(b) diffusing the ink dots adhered to the cloth within a range of from 0.2r to 3r as an increase in said dot diameter and simultaneously dyeing the cloth with a dye diffused in said cloth, by applying to said cloth, following step (a), a dry heat treatment at 100° C. to 200° C.; and (c) washing away that portion of said dye which has not been adsorbed or fixed.

29. The process according to claim 28, wherein said increase in said dot diameter in said step b is between 0.3r and 2.9r.

30. The process according to claim 28, wherein said increase in said dot diameter in said step b is between 0.5r and 2.8r.

31. The process according to claim 28, wherein said ink comprises at least one of a chloride ion and a sulfate ion present at a concentration of between 10 parts per million and 20,000 parts per million based on the dye contained in the ink.

32. The process according to claim 28, wherein said ink comprises a solvent having a vapor pressure of not more than 0.02 mmHg at 20° C.

33. The process according to claim 28, wherein said ink comprises a solvent comprising thiodiglycol or a mixed solvent of thiodiglycol and diethylene glycol.

34. The process according to claim 28, further comprising a step of pretreating said cloth before said step (a).

35. The process according to claim 28, wherein said ink-jet recording process is performed in an On-Demand system.

36. The process according to claim 28, wherein said ink-jet process is performed in a system utilizing a heat energy.

* * * * *